US007626604B2

(12) United States Patent
Ihara

(10) Patent No.: US 7,626,604 B2
(45) Date of Patent: Dec. 1, 2009

(54) THERMAL TRANSFER PRINTING MACHINE

(75) Inventor: Keiji Ihara, Kanagawa-ken (JP)

(73) Assignee: Victor Company of Japan, Limited, Yokohama-shi (JP)

( * ) Notice: Subject to any disclaimer, the term of this patent is extended or adjusted under 35 U.S.C. 154(b) by 354 days.

(21) Appl. No.: 11/812,714

(22) Filed: Jun. 21, 2007

(65) Prior Publication Data

US 2007/0296798 A1 Dec. 27, 2007

(30) Foreign Application Priority Data

Jun. 23, 2006 (JP) ..... P2006-173853

(51) Int. Cl.
*B41J 2/325* (2006.01)
*B41J 3/60* (2006.01)

(52) U.S. Cl. ..... 347/213

(58) Field of Classification Search ..... 347/213; 400/188

See application file for complete search history.

(56) References Cited

U.S. PATENT DOCUMENTS 6,447,182 B2 * 9/2002 Brewington et al. ..... 400/188
6,830,392 B2 * 12/2004 Kobayashi et al. ..... 400/120.01
7,119,823 B2 * 10/2006 Takahashi et al. ..... 347/213
7,133,059 B2 * 11/2006 Mochizuki et al. ..... 347/213

FOREIGN PATENT DOCUMENTS

JP 2003-145846 5/2003
JP 2005-238753 9/2005

* cited by examiner

*Primary Examiner*—Huan H Tran
(74) *Attorney, Agent, or Firm*—The Nath Law Group; Jerald L. Meyer; Derek Richmond

(57) ABSTRACT

A thermal transfer printing machine 10 for thermally transferring image information on an information carrying medium to a printing medium is provided. The thermal transfer printing machine 10 includes a first platen roller 11 adapted so as to be rotatable, a second platen roller 12 adapted so as to be rotatable, the second platen roller 12 being separated from the first platen roller 11 and also paralleled thereto substantially, and a thermal print head 21 disposed between the first and second platen rollers 11, 12. The thermal print head 21 is adapted so as to be movable between a first transfer position to allow the thermal print head 21 to oppose the first platen roller 11 and a second transfer position to allow the thermal print head 21 to oppose the second platen roller 12.

9 Claims, 10 Drawing Sheets

THERMAL PRINT HEAD PRESSED AGAINST PLATEN ROLLER

THERMAL PRINT HEAD SEPARATED FROM PLATEN ROLLER

THERMAL TRANSFER PRINTING MACHINE

BACKGROUND OF THE INVENTION

The present invention relates to a thermal transfer printing machine that thermally transfers image information from an information carrying medium (e.g. ink ribbon, re-transfer film after print, etc.) to a printing medium (e.g. printing paper, re-transfer film before print, etc.). In the thermal transfer printing machine, when the image information is transferred, the information carrying medium and the printing medium are pinched between a thermal print head and a rotatable platen roller. More particularly, the present invention relates to a thermal transfer printing machine having the thermal print head whose position is selectively changeable between first and second transfer positions.

As an example of such thermal transfer printing machines, it is known a thermal printing machine that adopts an ink ribbon, as an information carrying medium, in which fusible or sublimation multicolor inks [e.g. yellow (Y), magenta (M), cyan (C), and if necessary black (B)] are applied on a ribbon base with a long band shape, sequentially in the longitudinal direction, and a printing paper as a printing medium. In this thermal printing machine, the operation of transferring the multicolor inks from the ink ribbon to the printing paper is accomplished by a thermal print head generating heat corresponding to image signals for respective colors. In transferring, the ink ribbon and the printing paper are laid to overlap each other between the thermal print head and a rotatable platen roller. Note here that the transfer operation is repeated with respect to each color.

Japanese Patent Laid-Open Publication No. 2003-145846 (patent document 1) discloses a modification of the above-mentioned thermal transfer printing machine. In the modification, a printer is constructed so as to use two kinds of inks, allowing not only normal color printing but also special printing, such as metallic luster printing.

Japanese Patent Laid-Open Publication No. 2005-238753 (patent document 2) discloses another example of the thermal transfer printing machines. This thermal printing machine adopts an ink ribbon, as an information carrying medium, in which fusible or sublimation multicolor inks [e.g. yellow (Y), magenta (M), cyan (C), and if necessary black (B)] are applied on a ribbon base with a long band shape, sequentially in the longitudinal direction, and a re-transfer film, as a printing medium, in which a release layer and a transparent receiving layer are applied on a film base with a long band shape, in lamination. In this thermal printing machine, the operation of transferring the multicolor inks from the ink ribbon to the re-transfer film is accomplished by a thermal print head generating heat corresponding to image signals for respective colors. In transferring, the ink ribbon and the re-transfer film are laid to overlap each other between the thermal print head and a rotatable platen roller. Note here that the transfer operation is repeated with respect to each color, forming a color-image layer on the transparent receiving layer of the re-transfer film. Next, the color-image layer is peeled off from the release layer of the re-transfer film by a re-transfer heat roller, and further transferred to a printing paper, for example, card. Consequently, the card is printed with so-peeled image information such as characters and images. Such a thermal transfer printing machine is called the "re-transfer type printing machine".

FIG. 1 is a view showing the overall constitution of a printer disclosed in the patent document 1. While, FIG. 2 is a structural view showing a re-transfer type printing machine disclosed in the patent document 2.

In FIG. 1, the printer 100 denotes a printer disclosed in the patent document 1. We now explain the structure of the printer 100 with reference to the patent citation 1 in brief.

In this printer 100, a printing paper 102 wound around a reel 101 is taken out by a feed roller 103 and further fed by a plurality of transfer rollers 104 arranged along a transfer route. Then the so-fed printing paper 102 with a predetermined length is cut off by a cutter 106 in the vicinity of a guide plate 105 on the downstream side. Below the cutter 106, a collection box 107 is arranged in order to collect cutting pieces (printing papers) produced by the cutter 106.

Along the transfer route for the printing paper 102, there are provided a first printing unit 110 and a second printing unit 120 in order from the upstream side to the downstream side.

In the printing unit 110, a first ink ribbon 115 and the printing paper 102 in their overlapped state are fed in between a first thermal print head 111 and a first rotatable platen roller 112. Here, the first ink ribbon 115 is provided by applying a plurality of color inks (e.g. yellow, magenta, cyan, etc.) on a ribbon base repeatedly, and is wound around a pair of reels 113, 114.

Similarly, in the second printing unit 120 on the downstream side of the first printing unit 110, a second ink ribbon 125 and the printing paper 102 in their overlapped state are fed in between a second thermal print head 121 and a second rotatable platen roller 122. Here, the second ink ribbon 125 is provided by evaporating various pigments of gold, silver, metallic colors on a ribbon base, and is wound around a pair of reels 123, 124.

The first and second thermal print heads 111, 121 are constructed so as to be accessible to and separable from the first and second platen rollers 112, 122, respectively.

We now explain the operation of the above-constructed printer 100. When activating the first printing unit 110 on the establishment of the second printing unit 120 in its inactivated condition, the color printing onto the printing paper 102 is effected by feeding the first ink ribbon 115 and the printing paper 102 in between the first thermal print head 111 and the first platen roller 112 while rotating it in the direction of an illustrated arrow. Then, the printing paper 102 shuttles on the first platen roller 112 by several times, so that several inks are superimposed on an identical area on the printing paper 102, accomplishing the color printing.

Subsequently, when activating the second printing unit 120 on the establishment of the first printing unit 110 in its inactivated condition, the metallic printing onto the color-printed printing paper 102 is effected by feeding the second ink ribbon 125 and the printing paper 102 in between the second thermal print head 121 and the second platen roller 122 while rotating it in the direction of an illustrated arrow. In this way, the color printing and the metallic printing are finally applied on the printing paper 102.

In FIG. 2, a printing machine 200 illustrated therein is disclosed in the patent document 2. We now explain the structure of the printing machine 200 with reference to the patent citation 2 in brief.

In this printing machine 200, as shown at the right of FIG. 2, an ink ribbon 201 is wound off from a supply reel 202 and wound up to a take-up reel 203 while guided by a plurality of guide shafts 204. Note that this ink ribbon 201 is produced by repeatedly applying a plurality of fusible (or sublimatic) color inks (e.g. yellow, magenta, cyan, and if necessary black) on a ribbon base with a long band shape along its longitudinal direction. In the vicinity of an exit of the supply reel 202 having the ink ribbon 201 wound thereon, there is an ink ribbon sensor 205 for cueing. A thermal print head 206 is arranged between the supply reel 202 and the take-up reel 203.

At the left of the figure, a re-transfer film 211 within a long band shape is taken out from a supply reel 212 and wound up to a take-up reel 213 while guided by a plurality of guide shafts 214. Further, in the vicinity of an exit of the supply reel 212 having the re-transfer film 211 wound thereon, there is a film sensor 215 for cueing. Between the supply reel 212 and the take-up reel 213, a rotatable platen roller 216 is arranged so as to oppose the thermal head 206.

Either the thermal print head 206 or the platen roller 216 is adapted so as to be accessible to and separable from the other. With the rotation of the platen roller 216 in the direction of an illustrated arrow, the ink ribbon 201 and the re-transfer film 211 are transferred in between the thermal print head 206 and the platen roller 216 while laid to overlap each other.

On the side of the re-transfer film 211, a re-transfer film transporter 217 is arranged on the downstream side of the platen roller 216. The re-transfer film transporter 217 has a function of transferring the re-transfer film toward the take-up reel 213 by a film length corresponding to a predetermined transfer area.

Below the take-up reel 203 for ink ribbon, there are provided four card-loading rollers 222 for supplying a card (printing paper) 221, in vertical and horizontal arrangement. Due to these card-loading rollers 222, the card 221 is transferred in the direction of an illustrated arrow.

On the side of the re-transfer film 211, there are arranged a re-transfer heat roller 218 and a re-transfer opposing roller 219, both of which are rotatable on the downstream side of the re-transfer film transporter 217. The re-transfer heat roller 218 is adapted so as to be accessible and separable with respect to the re-transfer opposing roller 219 on the drive side, through a not-shown rotating arm. Between the re-transfer heat roller 218 and the re-transfer opposing roller 219, the re-transfer film 211 and the card 221 are laid to overlap each other and also transferred while pinched between the re-transfer heat roller 218 and the re-transfer opposing roller 219.

Further, a pair of card-unloading rollers 223, 223 for discharging the card 221 are rotatably arranged on the downstream side of the re-transfer heat roller 218 and the re-transfer opposing roller 219.

According to the patent citation 2, the re-transfer type printing machine 200 operates as follows.

First, between the thermal print head 206 and the rotatable platen roller 216, the ink ribbon 201 and the re-transfer film 211 (before print) are laid to overlap each other. While the re-transfer film transporter 217 on the downstream side of the platen roller 216 transfers the re-transfer film 211 of a predetermined length, respective colored inks applied on the ink ribbon 201 are transferred on the re-transfer film 211, repeatedly with respect to each color, due to heat generated from the thermal print head 206 receiving image signals for respective colors. In this way, the re-transfer film 211 is provided, in its designated transfer area, with a colored image layer. Subsequently, due to thermo-compression by the re-transfer heat roller 218 and the re-transfer opposing roller 219, the colored image layer is peeled away from the release layer of the re-transfer film 211 and further transferred onto the card 221 again.

SUMMARY OF THE INVENTION

The printer 100 disclosed in the patent citation 1 is capable of not only normal color printing but also specific printing of metallic colors etc. on the printing paper 102. However, the printer 100 has to be provided, in the first printing unit 110 and the second printing unit 120, with the first thermal print head 111 and the second thermal print head 121 both operated independently of each other. Due to their heavy price of the thermal print heads, the printer 100 is apt to become expensive.

In the re-transfer type printing machine 200 disclosed in the patent citation 2, the re-transfer heat roller 218 may be replaced by a thermal print head (not shown) for transferring the color-image information again.

In any case, as the re-transfer type printing machine 200 has to be provided with the thermal print head 206 for color printing and the re-transfer heat roller 218 (or the above not-shown thermal print head), the manufacturing cost of the machine 200 is elevated due to the necessity of these components.

Therefore, it has been recently desired to provide a thermal transfer printing machine having a low-cost structure capable of color printing and specific printing without adopting two thermal print heads and a re-transfer type printing machine having a low-cost structure capable of re-transferring the color-image information without adopting a thermal print head for color printing and a re-transfer heat roller (or re-transfer thermal print head).

Under such a circumstance, an object of the present invention is to provide a thermal transfer printing machine that is advantageous in manufacturing cost with a reduction in the number of thermal print heads.

In order to achieve the above object, there is provided a thermal transfer printing machine for transferring image information on an information carrying medium to a printing medium thermally, comprising a first platen roller adapted so as to be rotatable, a second platen roller adapted so as to be rotatable, the second platen roller being separated from the first platen roller and also paralleled thereto substantially, and a thermal print head disposed between the first platen roller and the second platen roller, for effecting a thermal transfer of the image information from the information carrying medium to the printing medium, wherein the thermal print head is adapted so as to be movable between a first transfer position to allow the thermal print head to oppose the first platen roller and a second transfer position to allow the thermal print head to oppose the second platen roller.

BRIEF DESCRIPTION OF THE DRAWINGS

FIGS. 4A and 4B are side views explaining the operation of the thermal-head press unit of the thermal transfer printing machine, in which FIG. 4A shows a state where the thermal print head is separated from a platen roller and FIG. 4B shows a state where the thermal print head is pressed against the platen roller;

DETAILED DESCRIPTION OF THE PREFERRED EMBODIMENTS

There will be below described several embodiments of a thermal transfer printing machine of the present invention with reference to FIGS. 3 to 12.

Figure 3:
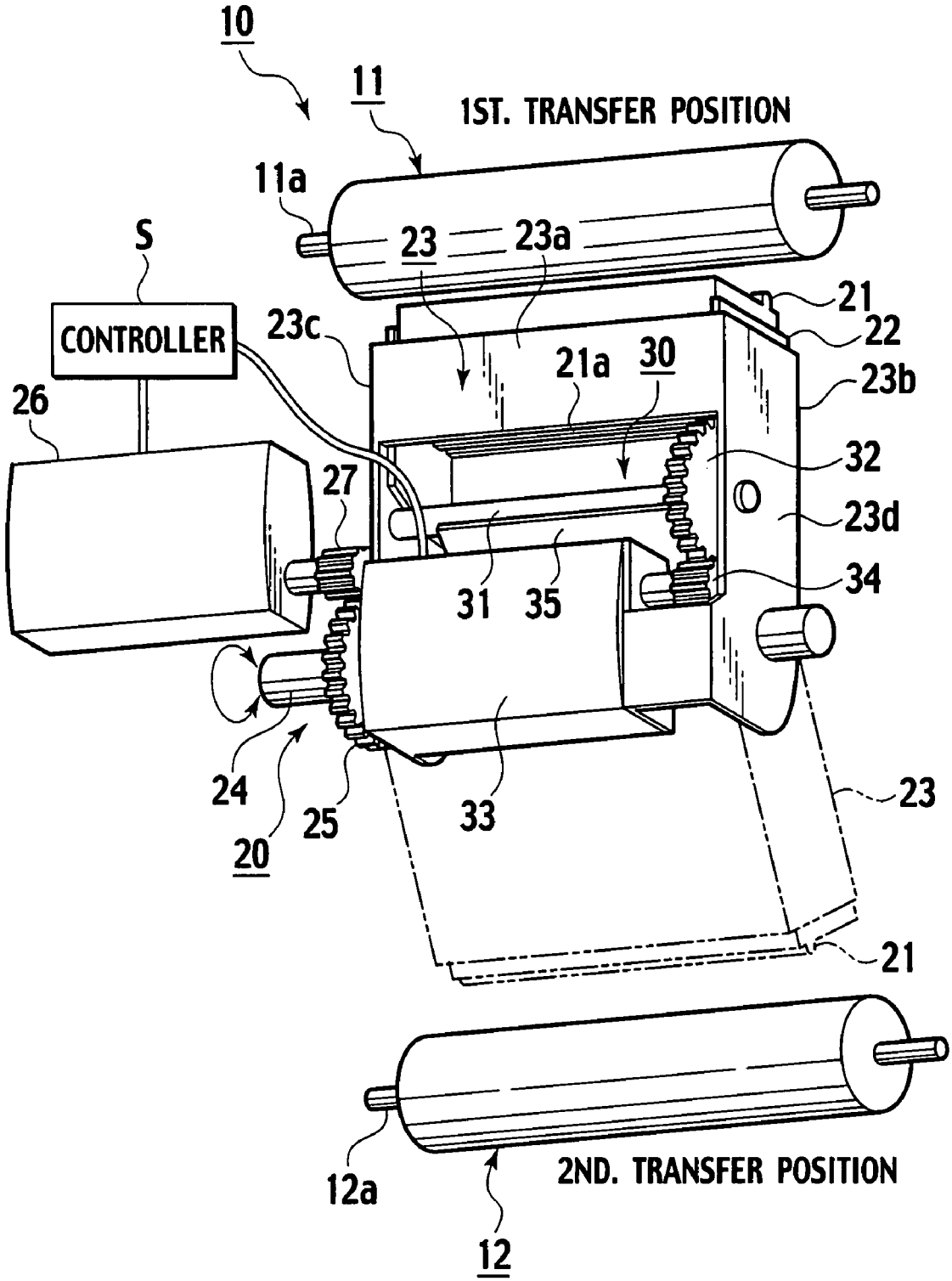
FIG. 3 is a perspective view of a thermal transfer printing machine of the present invention, showing a thermal-head transfer-position switching unit and a thermal-head press unit both constituting substantial parts of the machine.
Figure 4B:
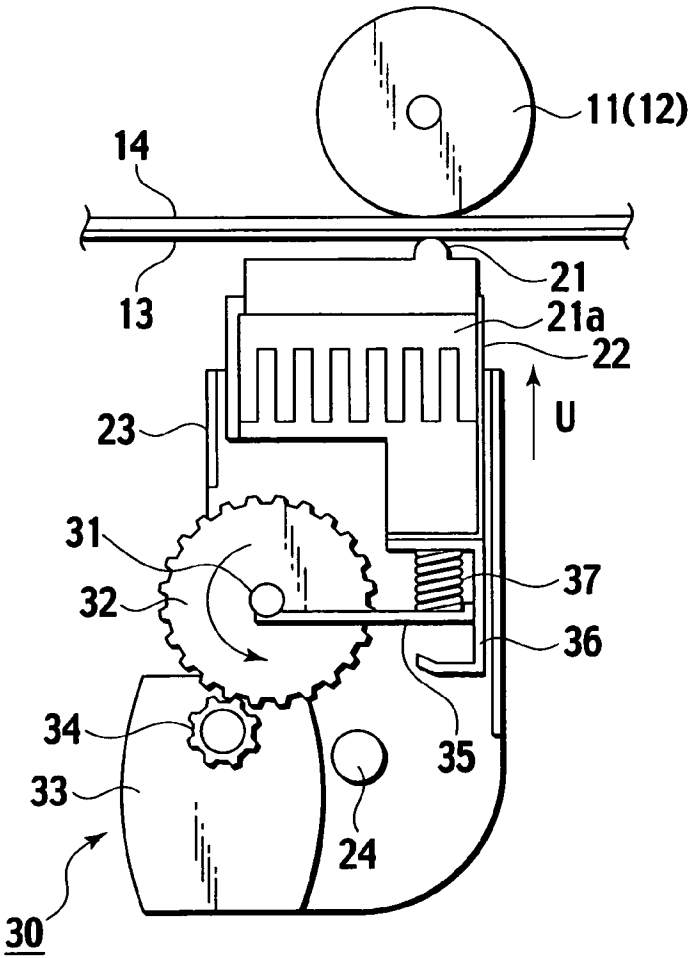
Figure 4A:
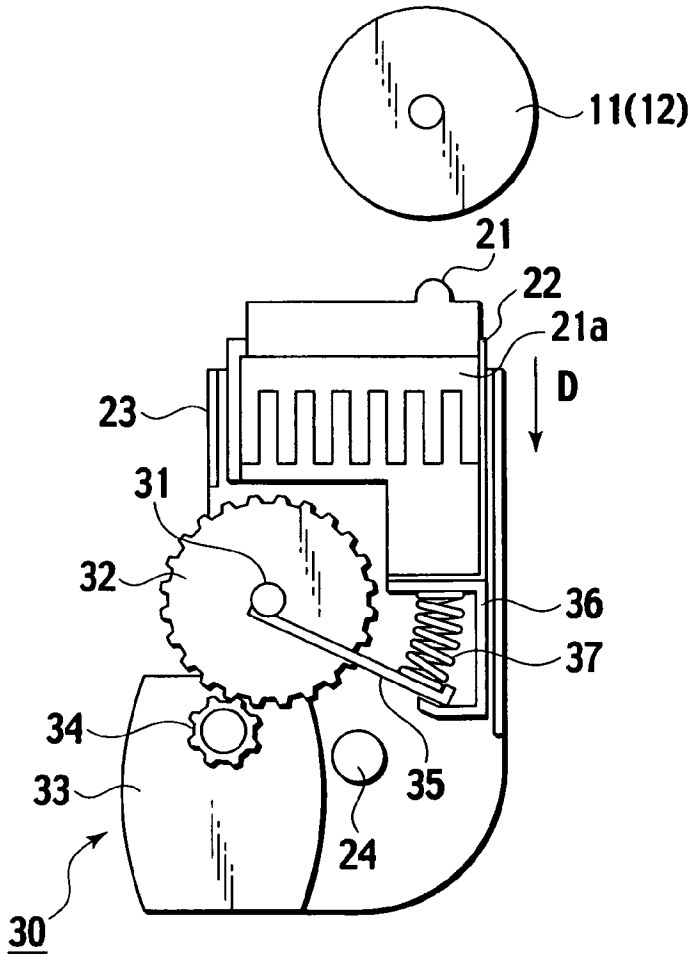

In advance of describing these thermal transfer printing machines, we now describe a thermal-head transfer-position switching unit for a thermal print head and a thermal-head press unit with reference to FIGS. 3, 4A, and 4B. Note that the thermal-head transfer-position switching unit and the thermal-head press unit are employed in common with respective thermal transfer printing machines of later-mentioned embodiments and modifications, constituting substantial parts of the present invention.

FIG. 3 is a perspective view showing the thermal-head transfer-position switching unit and the thermal-head press unit. FIGS. 4A and 4B are side views explaining the operation of the thermal-head press unit of the thermal transfer printing machine. FIG. 4A shows a state where the thermal print head is separated from a platen roller, while FIG. 4B shows a state where the thermal print head is pressed against the platen roller.

In FIG. 3, the printing machine 10 denotes a thermal transfer printing machine of the present invention. As shown in FIG. 3, the thermal transfer printing machine 10 includes a first platen roller 11 shaped cylindrically and made of rubber. The first platen roller 11 is arranged so as to be rotatable about a rotating shaft 11*a* made of metal. Departing from the first platen roller 11 by a predetermined distance, the thermal transfer printing machine 10 further includes a second platen roller 12 also shaped cylindrically and made of rubber. The second platen roller 12 is arranged so as to be parallel with the first platen roller 11 and be rotatable about a rotating shaft 12*a* made of metal. In positioning, the first platen roller 11 is positioned on the side of a first transfer position, while the second platen roller 12 is positioned on the side of a second transfer position. As for their driving, the first platen roller 11 and the second platen roller 12 are operationally connected to not-shown rotational driving sources, realizing active rotations of the rollers 11, 12. Alternatively, the rollers 11, 12 may be passively rotatable without being connected to such driving sources.

Between the first platen roller 11 on the side of the first transfer position and the second platen roller 12 on the side of the second transfer position, there is a thermal-head transfer-position switching unit 20 constituting a substantial part of the present invention. This transfer-position switching unit 20 corresponds to a thermal-head rotating unit for rotating a thermal print head 21 between the first transfer position and the second transfer position over a predetermined range of angles.

We here describe a concrete example of the thermal-head transfer-position switching unit 20 mentioned above.

In the thermal-head transfer-position switching unit (i.e. the thermal-head rotating unit of the invention) 20, the thermal print head 21 is provided, along the axial direction of the first and second platen rollers 11, 12, with a plurality of convex heaters (not shown) and a heat sink 21*a*. The convex heaters are formed on the front surface of a rectangular solid body, while the heat sink 21*a* is formed on the back surface of the rectangular solid body integrally.

The thermal print head 21 and the heat sink 21*a* are accommodated in a moving frame 22 integrally. The thermal print head 21 and the heat sink 21*a* are positioned on one side of the moving frame 22. The moving frame 22 is shaped so as to be a framework made from sheet metals. While, a later-mentioned spring stopper plate 36 (only shown in FIGS. 4A and 4B) is attached to the moving frame 22 integrally. The spring stopper plate 36 is positioned on the opposite side of the thermal print head 21.

In this way, the moving frame 22 accommodates the thermal print head 21 and the heat sink 21*a* therein and further includes the spring stopper plate 36 attached thereto. The moving frame 22 is fitted in one end of a thermal-head carrier 23 so as to be slidable vertically (both directions of arrows U and D of FIGS. 4A and 4B). Using sheet metals, the thermal-head carrier 23 is shaped to be a rectangular frame defined by front and rear walls 23*a*, 23*b* and left and right sidewalls 23*c*, 23*d*. The thermal print head 21 is capable of approaching and departing from the first platen roller 11 and the second platen roller 12 by a later-mentioned thermal-head press unit (i.e. a thermal-head moving unit) 30 through the moving frame 22.

On the other side of the thermal-head carrier 23, a first shaft 24 is arranged so as to bridge over a gap between the left sidewall 23*c* and the right sidewall 23*d* while substantially paralleled with a rotating shaft 11*a* of the first platen roller 11 and a rotating shaft 12*a* of the second platen roller 12. Both ends of the first shaft 24 project from the left and right sidewalls 23*c*, 23*d* outwardly. In positioning, the first shaft 24 is arranged at an intermediate position between the first platen roller 11 and the second platen roller 12. Additionally, the first shaft 24 is supported, through both ends thereof, by a not-shown chassis.

Outside the left sidewall 23*c* of the thermal-head carrier 23, a thermal-head rotating gear 25 is fitted to the first shaft 24 and also fixed on the left sidewall 23*c* of the carrier 23 integrally. This thermal-head rotating gear 25 meshes with a first pinion gear 27 fixed on an output shaft of a geared motor 26 for rotating the thermal print head 21. The geared motor 26 is fixed on the above chassis (not shown), forming a first motor of the invention.

A controller S is arranged to control the operation of the thermal transfer printing machine 10. The geared motor 26 is driven by a control signal outputted from the controller S. In operation, when the thermal-head rotating gear 25 is rotated by the geared motor 26 through the first pinion gear 27, the thermal print head 21 in one body with the thermal-head carrier 23 rotates about the first shaft 24 as a rotating center over a predetermined range of angles between the side of the first platen roller 11 corresponding to the first transfer position and the side of the second platen roller 12 corresponding to the second transfer position, in both normal and opposite directions. In connection, regarding the relationship between the thermal-head carrier 23 in integral with the thermal-head rotating gear 25 and the first shaft 24, there may be employed either one supporting form where both ends of the first shaft 24 are fixed to the not-shown chassis so that the thermal-head carrier 23 and the thermal-head rotating gear 25 are rotatably supported by the first shaft 24 or another supporting form where the thermal-head carrier 23 and the thermal-head rotating gear 25 are fixed to the first shaft 24 so that both ends of the first shaft 24 are rotatably supported by the not-shown chassis.

As for a method of positioning the thermal print head 21 in either the first transfer position or the second transfer position, there may be selected either one method of pulse-driving the geared motor 26 so as to rotate by a predetermined angle or another method of controlling the drive of the geared motor 26 based on detection signals outputted from positioning sensors (not shown) in the vicinity of the first transfer position and the second transfer position.

Owing to the provision of the thermal-head transfer-position switching unit (corres. the thermal-head rotating unit of the invention) 20, therefore, the position of the thermal print head 21 can be selectively switched between the first transfer position opposing the first platen roller 11 and the second transfer position opposing the second platen roller 12 with such a simple structure.

The thermal-head press unit 30 is attached to the thermal-head carrier 23 forming a base for the thermal-head transfer-position switching unit (the thermal-head rotating unit) 20. The thermal-head press unit 30 corresponds to a thermal-head moving unit for allowing the thermal print head 21 to approach the first and second platen rollers 11, 12 and depart from these rollers 11, 12.

We now describe a concrete example of the thermal-head press unit (i.e. the thermal-head moving unit of the invention) 30.

In the thermal-head press unit 30, a second shaft 31 is arranged at an intermediate position of the thermal-head carrier 23 so as to bridge over a gap between the left sidewall 23*c* and the right sidewall 23*d*, in parallel with the first shaft 24. The second shaft 31 has its both ends rotatably supported by the sidewalls 23*c*, 23*d*, respectively. Inside the right sidewall 23*d* of the thermal-head carrier 23, a thermal-head press gear 32 is secured on the second shaft 31. The thermal-head press gear 32 meshes with a second pinion gear 34. This second pinion gear 34 is attached to an output shaft of a geared motor 33 for pressing the thermal print head 21. The geared motor 33 is fixed to the thermal-head carrier 23 integrally, forming a second motor of the invention.

Further, a spring pusher plate 35 is secured, through its one end, to the second shaft 31. Thus, the spring pusher plate 35 is rotatable integrally with the second shaft 31.

In the thermal-head press unit 30, as described before, the spring stopper plate 36 is integrally attached to the other end of the moving frame 22 accommodating the thermal print head 21 and the heat sink 21*a* (see FIGS. 4A and 4B). Therefore, the spring stopper plate 36 is also slidable up and down in the thermal-head carrier 23 together with the thermal print head 21 and the heat sink 21*a*.

The spring stopper plate 36 is made from a sheet metal bent to be U-shaped substantially. Arranged in the U-shaped spring stopper plate 36 is a compression spring 37 whose one end is secured to the other side of the moving frame 22. The other end of the spring pusher plate 35 rotating together with the second shaft 31 abuts on the other end of the compression spring 37. Thus, the compression spring 37 is adapted so as to be extensible in association with the rotational movement of the other end of the spring pusher plate 35.

In the thermal-head press unit 30 shown in FIG. 4A, the second pinion gear 34 fixed on the output shaft of the geared motor 33 is brought into a standstill condition to stop rotating. Then, the thermal-head press gear 32 in mesh with the second pinion gear 34 is also brought into a standstill condition to stop rotating. Such a situation is defined as an initial state of the thermal-head press unit 30.

When the thermal-head press unit 30 is in the initial state, the spring pusher plate 35 has one end secured to the second shaft 31 of the thermal-head press gear 32 and the other end urged by the expanding compression spring and also restricted by the lower end of the U-shaped spring stopper plate 36. In this state, all of the thermal print head 21, the heat sink 21*a* and the spring stopper plate 36 are integrally moved in the thermal-head carrier 23 downwardly in the figure (a direction of arrow D), so that the thermal print head 21 departs from the first platen roller 11 (or the second platen roller 12) greatly.

On the contrary, as shown in FIG. 4B, when driving the geared motor 33 of the thermal-head press unit 30 by the control signals from the controller S in the thermal transfer printing machine 10 so that the thermal-head press gear 32 rotates in the counter clockwise direction through the second pinion gear 34, the second shaft 31 of the thermal-head press gear 32 also rotates in the counter clockwise direction. As a result, the spring pusher plate 35 having its one end secured to the second shaft 31 pushes the compression spring 37 through the intermediary of the other end of the plate 35. Thus, as a repulsive force of the compression spring 37 causes the thermal print head 21, the heat sink 21*a* and the spring stopper plate 36 to all slide upwardly (i.e. in the direction of arrow "U") in the thermal-head carrier 31, the thermal print head 21 is pressed against the first platen roller 11 (or the second platen roller 12) through the intermediary of the ink ribbon 13 and the printing paper 14.

Subsequently, when it is required to bring the thermal-head press unit 30 into its initial state of FIG. 4A, the geared motor 33 of the thermal-head press unit 30 has only to be rotated in the opposite direction.

With the above-mentioned structure, the thermal print head 21 becomes accessible to the first and second platen rollers 11, 12 and also separable from the rollers 11, 12 irrespective of the transfer positioning of the thermal print head 21 (i.e. in the first transfer position and the second transfer position) due to the thermal-head press unit 30.

Additionally, as the thermal-head press unit 30 is attached to the thermal-head carrier 23, the thermal transfer printing machine 10 can be manufactured at a low price in comparison with an arrangement where thermal-head press units are arranged in the first transfer position and the second transfer position, respectively.

The above-mentioned arrangement where the thermal-head press unit 30 urges the thermal print head 21 against the first platen roller 11 or the second platen roller 12 may be modified as follow. In this modification, the printing machine is modified so as to press the first and second platen roller 11, 12 against the thermal print head 21 on the assumption of rotatably supporting it about not-shown shafts projecting from the sidewalls 23*c*, 23*d*, in parallel with the rotating shafts 11*a*, 12*a* of the platen rollers 11, 12. However, it is noted that this modification requires two thermal-head press units in charge of the first and second platen roller 11, 12. Therefore, it could be said that the illustrated arrangement where the thermal-head carrier 23 is equipped with the thermal-head press unit 30 is advantageous in comparison with the above modification.

Next, two embodiments of the present invention will be described in order. In common, the thermal-head transfer-position switching unit 20 and the thermal-head press unit 30 both forming the substantial parts of the present invention are applied to each thermal transfer printing machine. Throughout these embodiments, common elements will be indicated with the same reference numerals, respectively.

1st. Embodiment

Figure 5:
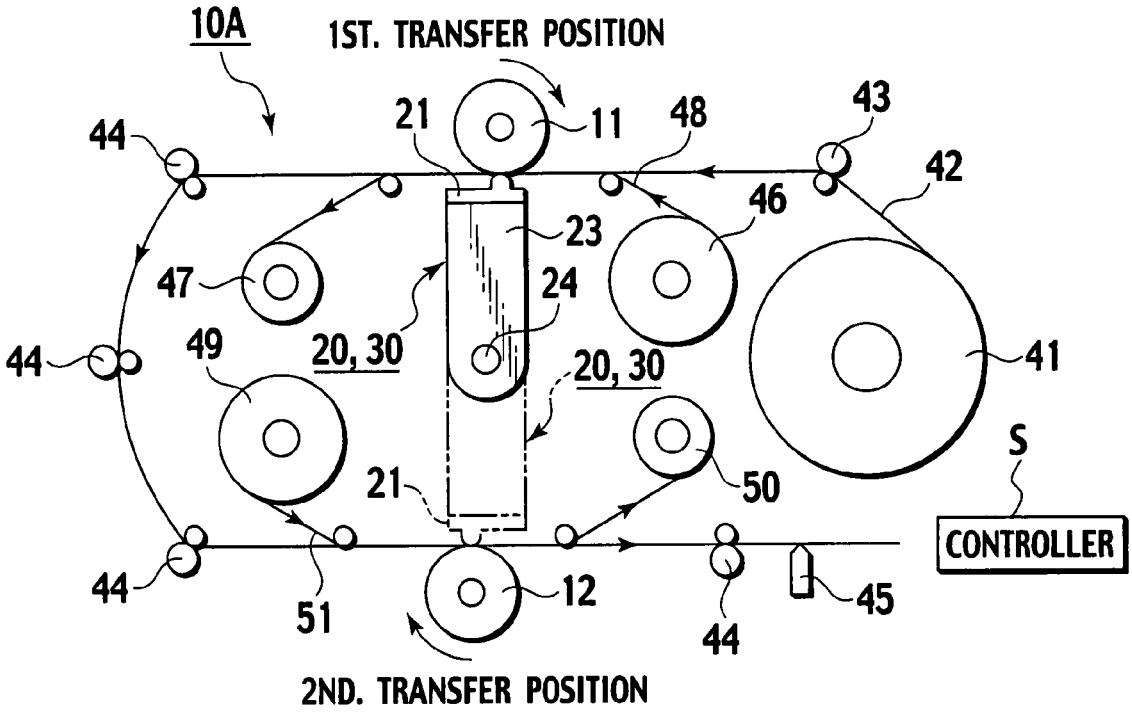
FIG. 5 is a structural view showing a thermal transfer printing machine in accordance with a first embodiment of the present invention schematically.

FIG. 5 is a structural view of the thermal transfer printing machine in accordance with the first embodiment of the present invention schematically.

In the thermal transfer printing machine 10A of the first embodiment, as shown in FIG. 5, the first platen roller 11 is rotatably arranged on the side of the first transfer position, while the second platen roller 12 is also rotatably arranged on the second transfer position separated from the first platen roller 11 by a predetermined distance. The second platen roller 12 is substantially parallel to the first platen roller 11.

Between the first platen roller 11 on the side of the first transfer position and the second platen roller 12 on the side of the second transfer position, there are arranged the thermal-head transfer-position switching unit 20 and the thermal-head press unit 30 both of which are previously described with reference to FIGS. 3, 4A and 4B. Due to the thermal-head transfer-position switching unit 20, the thermal print head 21 in the thermal head carrier 23 can rotate about the first shaft 24 in both normal and opposite directions over a predetermined range of angles (e.g. approx. 180°), allowing the head 21 to oppose either the first platen roller 11 or the second platen roller 12 selectively. Additionally, due to the thermal-head press unit 30, the thermal print head 21 can approach and depart from the first platen roller 11 or the second platen roller 12.

A printing paper 42 wound around a reel 41 is taken out by a feed roller 43. While transferred by a plurality of transfer rollers 44 along a transfer path, the printing paper 42 runs below the first platen roller 11 on the upstream side and also runs above the second platen roller 12 on the downstream side. After being transferred by a predetermined length, the printing paper 42 is cut off by a cutter 45 on the downstream side of the second transfer position platen roller 12.

A first ink ribbon 48 is wound around a reel 46 and rolled up by a take-up reel 47. This first ink ribbon 48 is produced by applying a plurality of color inks (e.g. yellow, magenta, cyan, etc.) on a ribbon base repeatedly. In the printing machine, the first ink ribbon 48 is supplied from the reel 46 and fed into a gap between the thermal print head 21 at the first transfer position and the first rotatable platen roller 11 while laid to overlap the printing paper 42.

On the other hand, a second ink ribbon 51 is wound around a reel 49 and rolled up by a take-up reel 50. This second ink ribbon 51 is produced by evaporating various pigments of gold, silver, metallic colors on a ribbon base. In the printing machine, the second ink ribbon 51 is supplied from the reel 49 and fed into a gap between the thermal print head 21 at the second transfer position and the second rotatable platen roller 12 while laid to overlap the printing paper 42.

As described above, according to the first embodiment, the second ink ribbon 51 is coated, on its base, with evaporated pigments, such as gold, silver and metallic colors. Otherwise, without being limited to this embodiment only, the second ink ribbon may be further coated with over-coating material for protecting colored printing, UV (ultra violet) photosensitive dye or the like.

Additionally, the controller S is arranged to control the operation of the thermal transfer printing machine 10A of the first embodiment.

We now describe the printing operation of the thermal transfer printing machine 10A constructed above. In the thermal transfer printing machine 10A, both color printing and metallic printing are performed as follows. In the color printing, the position of the thermal print head 21 is switched to the first transfer position by the thermal-head transfer-position switching unit 20 receiving a command from the controller S. While rotating the first platen roller 11 in the direction of shown arrow, the first ink ribbon 48 and the printing paper 42 are held tightly between the thermal print head 21 and the first platen roller 11. Simultaneously, the controller S supplies the thermal print head 21 with image signals. During the color printing, the printing paper 42 between the thermal print head 21 and the first platen roller 11 shuttles for several times, so that a plurality of inks are laid to overlap each other on the identical area of the printing paper 42, effecting the color printing of image information, such as characters and images.

In the metallic printing, the position of the thermal print head 21 is switched from the first transfer position to the second transfer position by the thermal-head transfer-position switching unit 20 receiving a command from the controller S. Additionally, while rotating the second platen roller 12 in the direction of shown arrow, the second ink ribbon 51 and the printing paper 42 (after the color printing) are held tightly between the thermal print head 21 and the second platen roller 12. Simultaneously, the controller S supplies the thermal print head 21 with image signals to apply the metallic printing on the printing paper 42 printed with colors. In this way, the color printing and the metallic printing are applied on the printing paper 42 finally.

Figure 1:
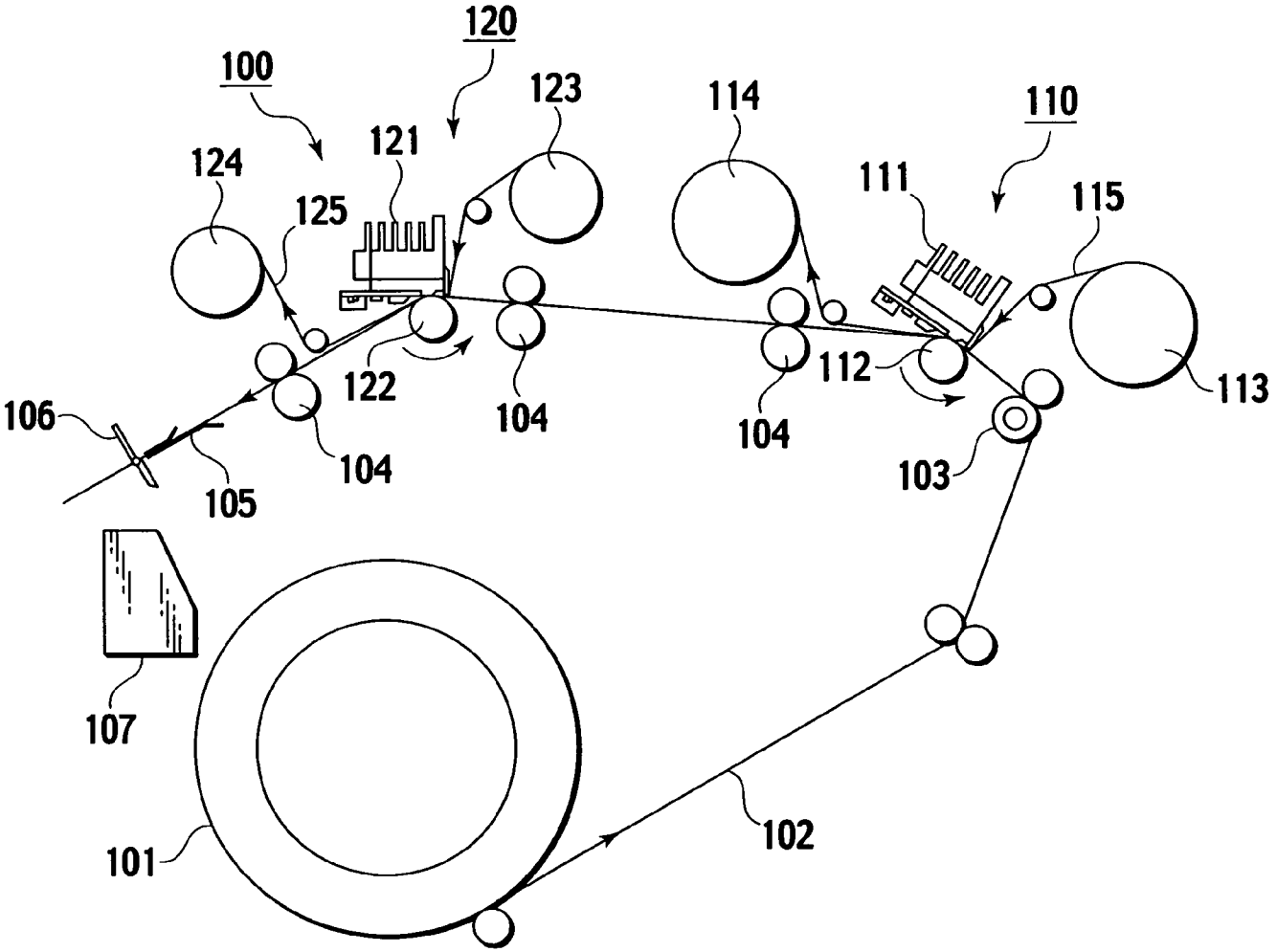
FIG. 1 PRIOR ART
FIG. 1 is a view showing an overall constitution of a printer in a first prior art.
Figure 2:
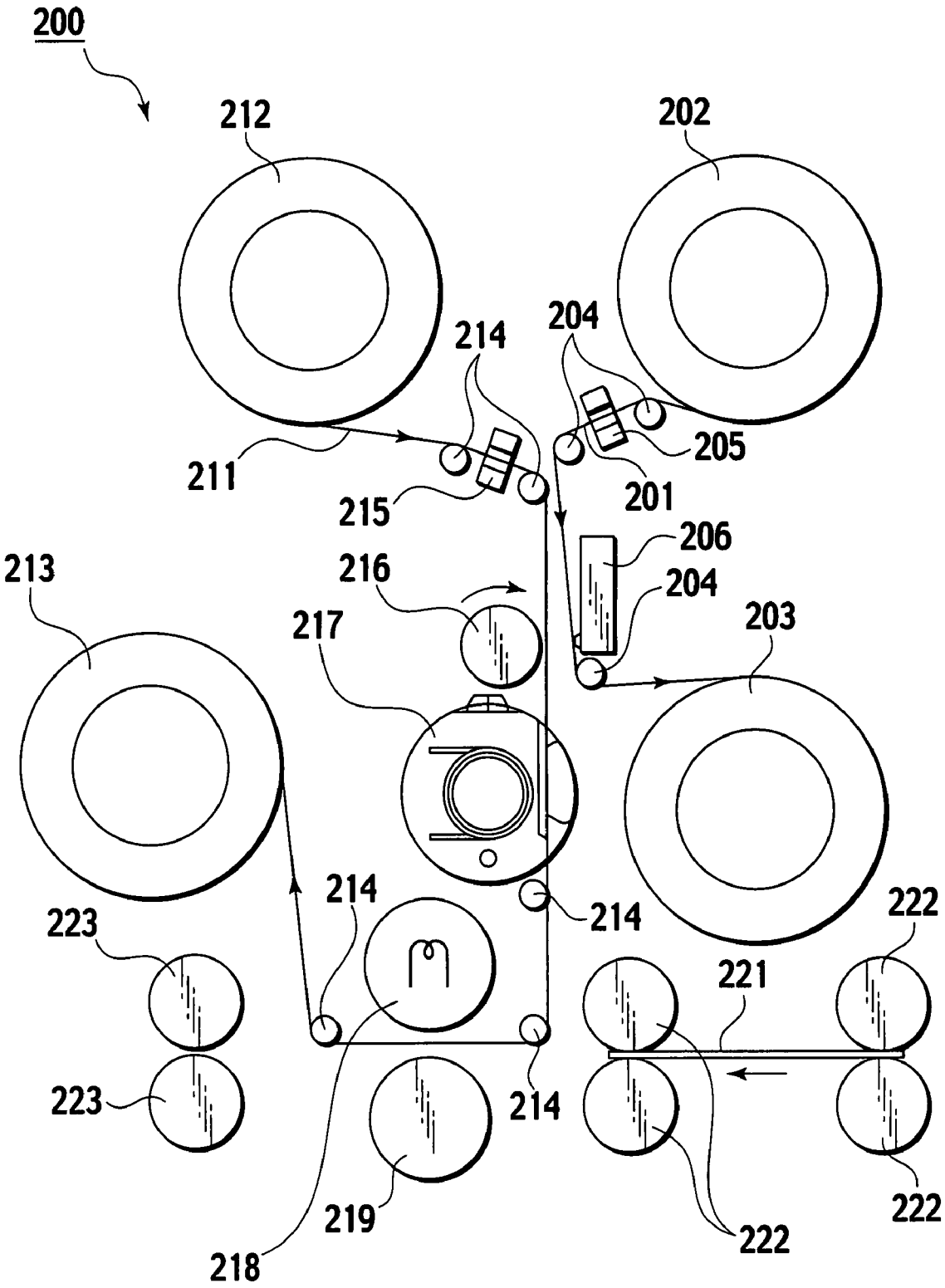
FIG. 2 PRIOR ART
FIG. 2 is a structural view showing a re-transfer type printing machine in a second prior art.

Thus, the thermal transfer printing machine 10A of the first embodiment cannot accomplish two printing operations in the first transfer position and the second transfer position simultaneously. However, owing to the provision of the rotatable thermal print head 21, it is possible to continuously perform two kinds of printing operations from various printing operations (e.g. color printing, metallic printing, over-coat printing, UV photosensitive dye printing, etc.). Different from the conventional printer 100 (see FIG. 1) adopting two expensive thermal print heads, therefore, the thermal transfer printing machine 10A of this embodiment can be manufactured at a low price.

One modification of the thermal transfer printing machine 10A of the first embodiment will be described with reference to FIG. 6 in brief. Note that the descriptions are related to only differences between the first embodiment and the modification.

Figure 6:
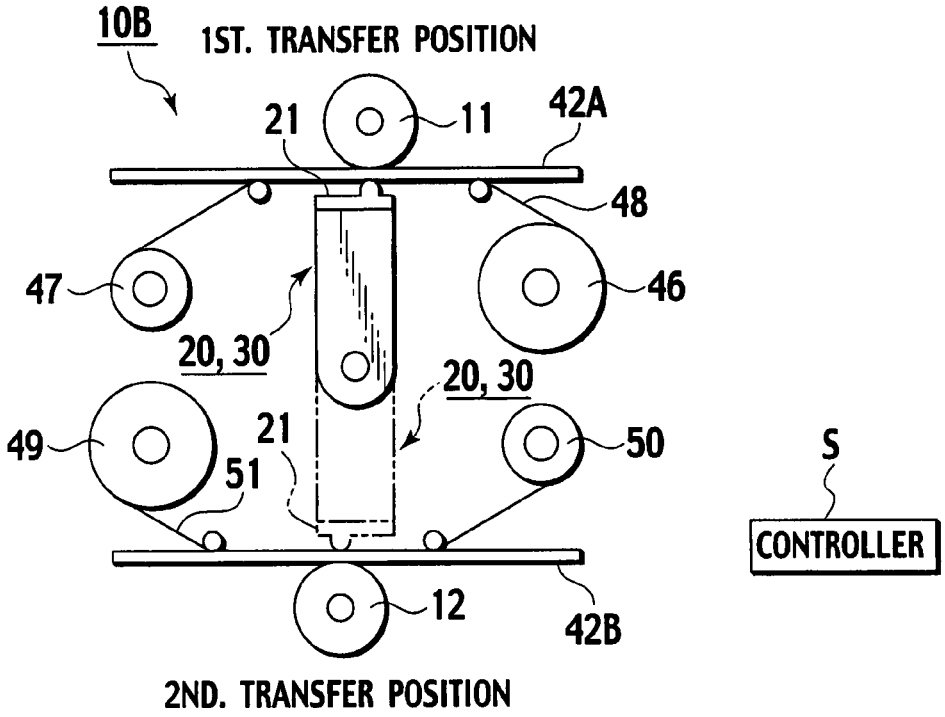
FIG. 6 is a structural view showing a modification of the thermal transfer printing machine in accordance with the first embodiment schematically.

FIG. 6 is a structural view of a thermal transfer printing machine 10B obtained by modifying a part of the thermal transfer printing machine 10A of the first embodiment.

As obvious from FIG. 6, the thermal transfer printing machine 10B is identical to the thermal transfer printing machine 10A in that the thermal print head 21 is adapted so as to allow its position to be selectively switched between the first transfer position and the second transfer position by the thermal-head transfer-position switching unit 20. While, the thermal transfer printing machine 10B differs from the thermal transfer printing machine 10A in that two sheets of printing papers 42A, 42B are prepared in the first transfer position and the second transfer position individually.

In case of this modification, the printing paper 42A and the printing paper 42B may be formed by different kinds of printing papers. Alternatively, in case of an identical printing paper, the printing may be applied on both sides of the identical printing paper. Additionally, the first ink ribbon 48 and the second ink ribbon 51 may be formed by either one kind of ink ribbon or different kinds of ink ribbons. Since the thermal transfer printing machine 10B is also constructed so as to allow the printing papers 42A, 42B to be selectively printed by the thermal print head 21 in spite of its impossibility of simultaneous printing in the first and second transfer positions, the thermal transfer printing machine 10B can be manufactured at a low price as well. Similarly in this modification, the controller S is adapted so as to supply the thermal print head 21 moved to the first transfer position or the second transfer position with image signals selectively.

$2^{nd}$. Embodiment

Figure 7:
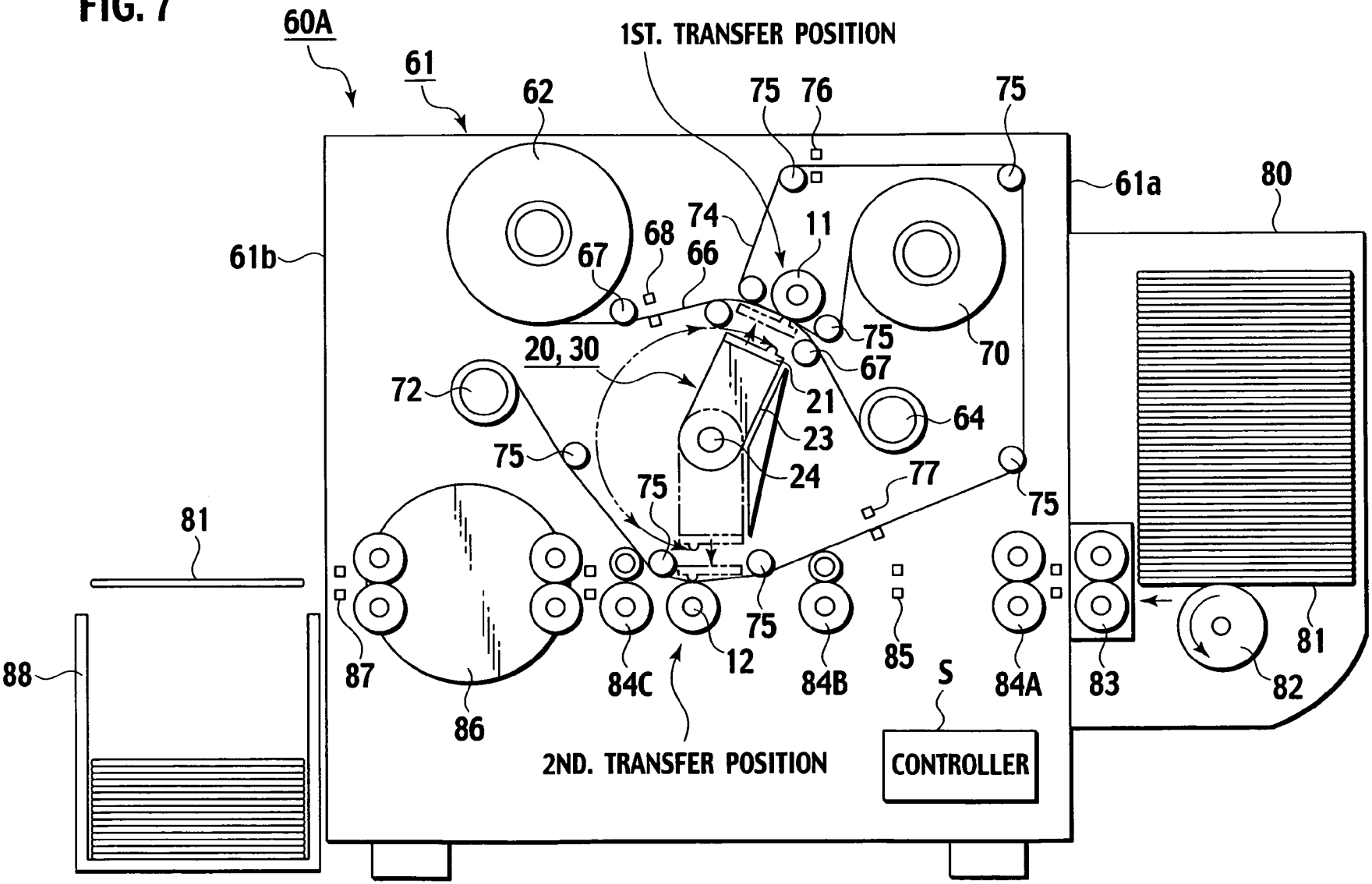
FIG. 7 is an overall structural view showing a thermal transfer printing machine in accordance with a second embodiment of the present invention.
Figure 8A:
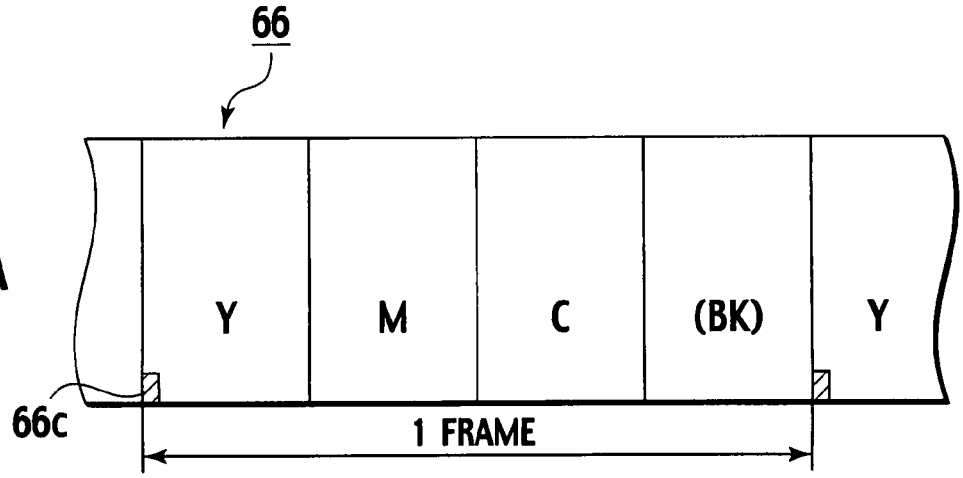
FIG. 8A is a plan view of an ink ribbon in FIG. 7 in enlargement and FIG. 8B is a longitudinal sectional view of the ink ribbon.
Figure 8B:
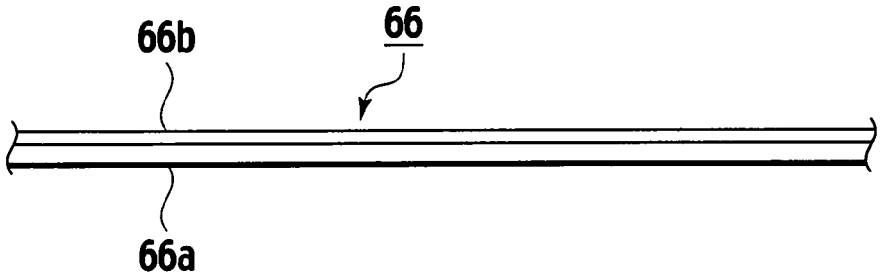
Figure 9A:
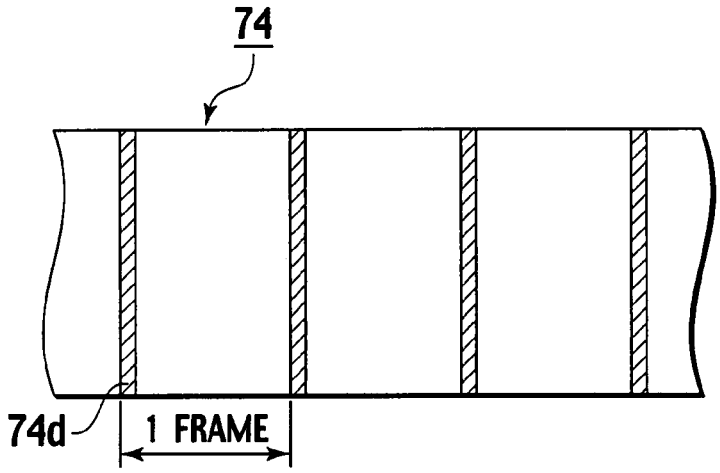
FIG. 9A is a plan view of a re-transfer film in FIG. 7 in enlargement and FIG. 9B is a longitudinal sectional view of the re-transfer film.
Figure 9B:
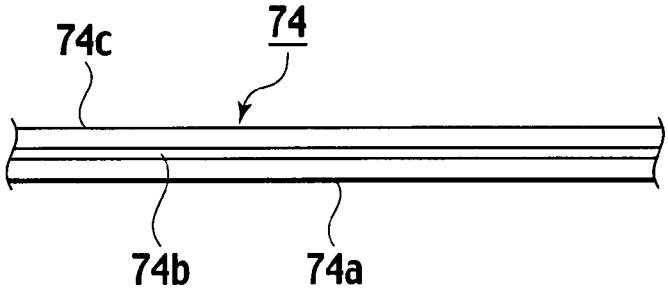
Figure 10:
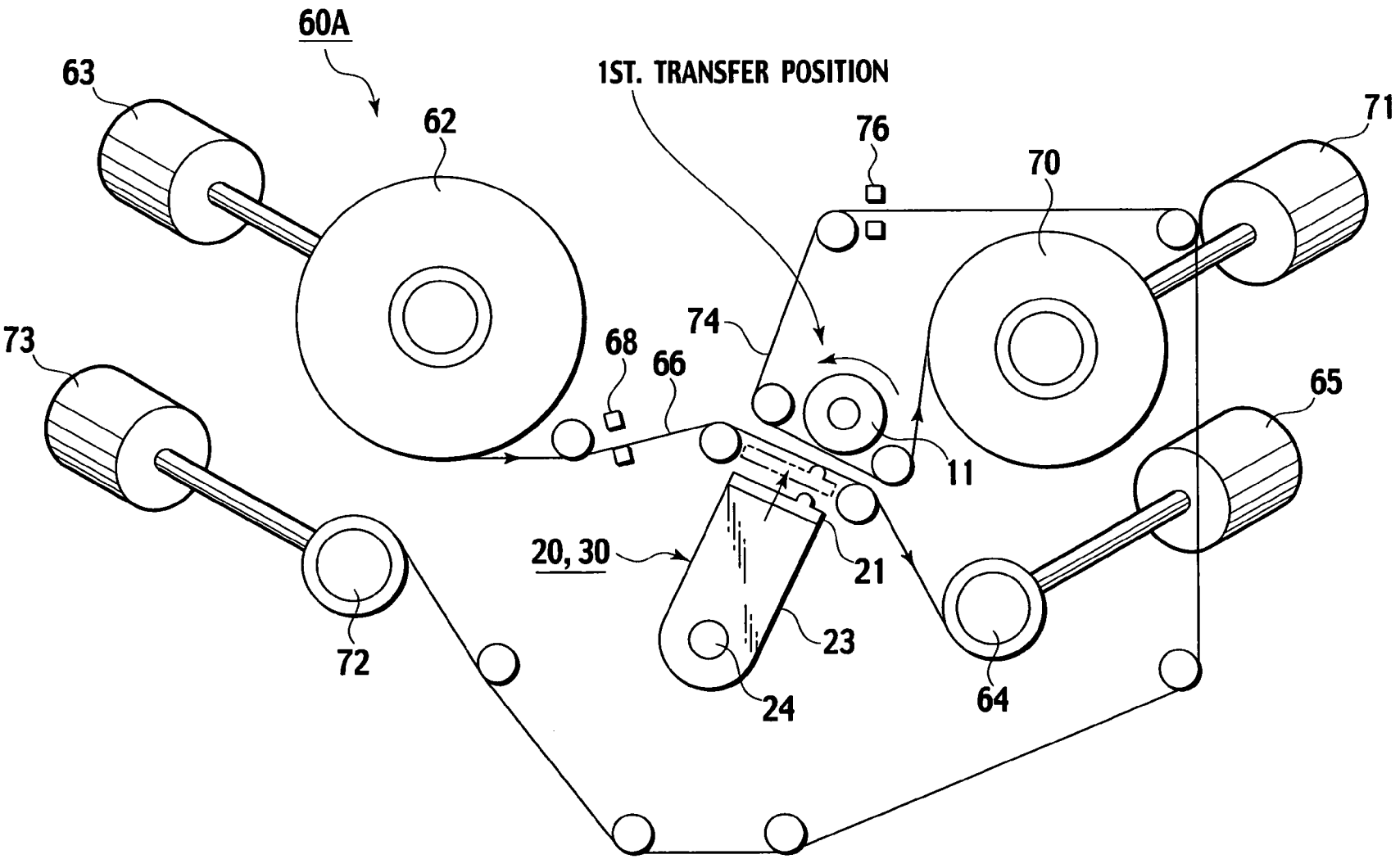
FIG. 10 is a view explaining the operation of applying color printing on a re-transfer film in the thermal transfer printing machine in accordance with the second embodiment.
Figure 11:
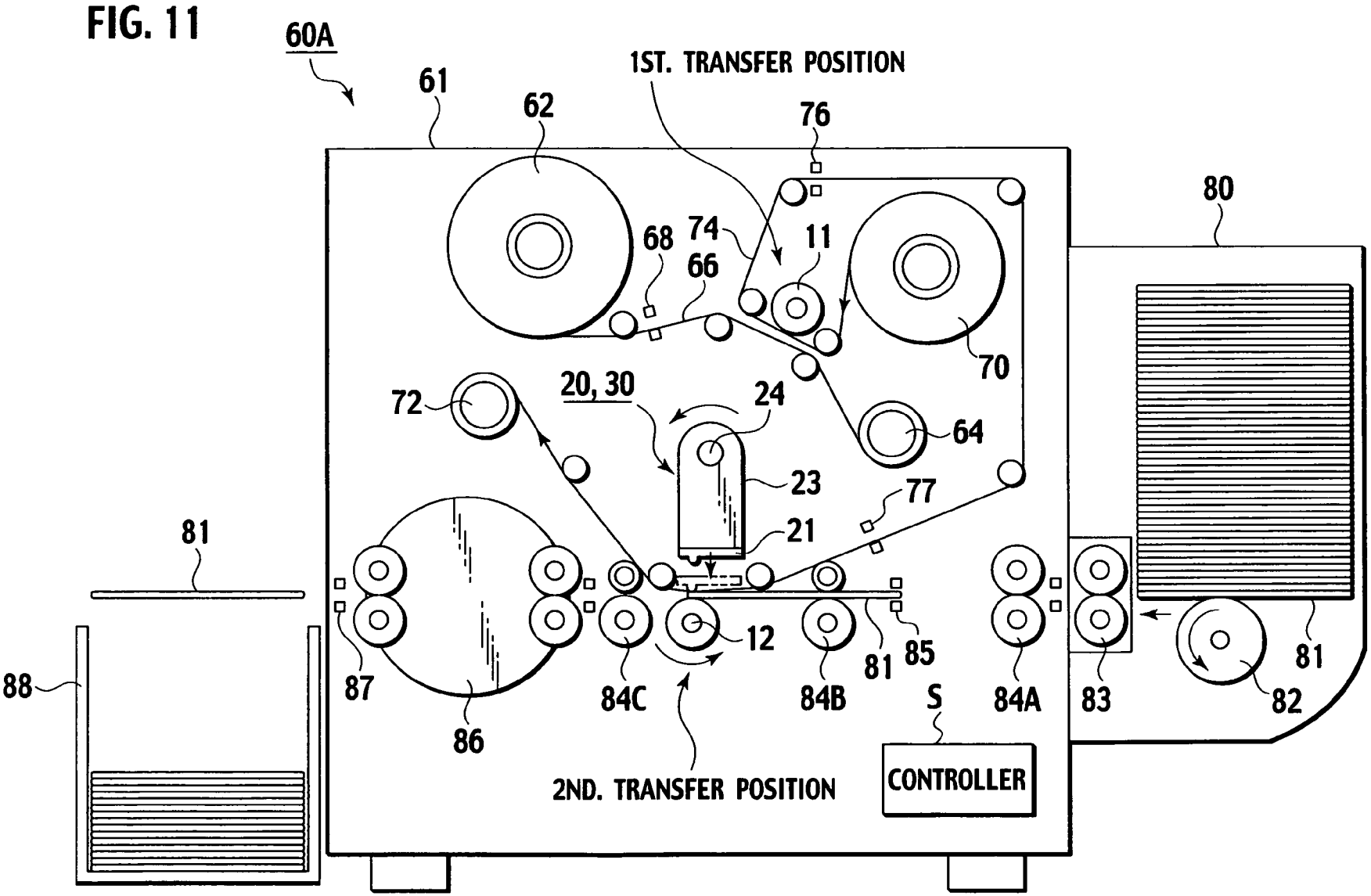
FIG. 11 is a view explaining the operation of re-transferring color-image information printed on the re-transfer film to a card in the thermal transfer printing machine in accordance with the second embodiment.

FIG. 7 is an overall structural view showing a thermal transfer printing machine in accordance with the second embodiment of the present invention. FIG. 8A is a plan view of an ink ribbon in FIG. 7 in enlargement, while FIG. 8B is a longitudinal sectional view of the ink ribbon. FIG. 9A is a plan view of a re-transfer film in FIG. 7 in enlargement, while FIG. 9B is a longitudinal sectional view of the re-transfer film. FIG. 10 is a view explaining the operation of applying color printing on a re-transfer film in the thermal transfer printing machine of the second embodiment of the present invention. FIG. 11 is a view explaining the operation of re-transferring color-image information printed on the re-transfer film to a card in the thermal transfer printing machine of the second embodiment of the present invention.

As obvious from FIG. 7, the thermal transfer printing machine 60A of the second embodiment is constructed so as to perform a re-transfer printing operation where image information printed on an information carrying medium (e.g. re-transfer film) is further transferred to a printing medium (e.g. card).

In the thermal transfer printing machine 60A, the first platen roller 11 is rotatably arranged on the side of the first transfer position defined in an upper right section inside a casing 61 in the form of a box. While, the second platen roller 12 is rotatably arranged on the side of the second transfer position in a center lower section inside the casing 61, in substantial parallel with the first platen roller 11.

Between the first platen roller 11 on the side of the first transfer position and the second platen roller 12 on the side of the second transfer position, there are arranged the thermal-head transfer-position switching unit 20 and the thermal-head press unit 30 both of which are previously described with reference to FIGS. 3, 4A and 4B. Due to the thermal-head transfer-position switching unit 20, the thermal print head 21 in the thermal head carrier 23 can rotate about the first shaft 24 in both normal and opposite directions over a predetermined range of angles (e.g. approx. 210 degrees), allowing the head 21 to oppose the first platen roller 11 or the second platen roller 12 selectively. Additionally, due to the thermal-head press unit 30, the thermal print head 21 can approach and depart from the first platen roller 11 or the second platen roller 12.

In an upper left section inside the casing 61, a first supply reel 62 for supplying an ink ribbon 66 is arranged in association with a motor 63 (see FIG. 10). Over the first platen roller 11 and in an intermediate right section inside the casing 61, a first take-up reel 64 for winding the ink ribbon 66 is arranged in association with a motor 65 (see FIG. 10). The ink ribbon 66 is wound around the first supply reel 62. The ink ribbon 66 is taken out from the first supply reel 62 and further guided along a plurality of guide shafts 67. Subsequently passing below the first platen roller 11, the ink ribbon 66 is wound up to the first take-up reel 64. Further, in the vicinity of an exit of the supply reel 62 in the transfer route of the ink ribbon 62, a first photo sensor 68 is arranged in order to detect a cueing position of the ink ribbon 66.

As shown in FIGS. 8A and 8B in enlargement, the ink ribbon 66 is produced by repeatedly applying fusible or sublimation multicolor inks [e.g. three colors of yellow (Y), magenta (M) and cyan (C) or four colors of yellow (Y), magenta (M), cyan (C) and black (B)], which constitute one frame of image information for an object to be printed, on a ribbon base 66*a* with a long band shape, in the longitudinal (transferring) direction of the ink ribbon 66. The ink ribbon 66 is arranged so that the ribbon base 66*a* faces the thermal print head 21 while an ink layer 66*b* faces a transparent receiving layer 74*c* (FIG. 9) of a later-mentioned re-transfer film 74 and the first and second platen rollers 11, 12. The ink ribbon 66 is provided, at a leading part of the yellow part, with a black-lacquered cueing mark 66*c* that is effective in applying the multicolor inks on the ribbon base 66*a* repeatedly. In connection, the ink ribbon 66 may be provided with no cueing mark on the assumption that the cueing operation of the ink ribbon 66 is carried out through the use of a difference in spectral transmittance between magenta (M) and cyan (C) without the cueing mark 66*a*.

Returning to FIG. 7, in the upper right section inside the casing 61 and above the first take-up reel 64, there is a second supply reel 70 for supplying the re-transfer film 74. The second supply reel 70 is operatively connected to a motor 71 (see FIG. 10). In an intermediate left section inside the casing 61 and below the first supply reel 62, a second take-up reel 72 for winding the re-transfer film is arranged in association with a motor 73 (see FIG. 10). The re-transfer film 74 is wound around the second supply reel 70. The re-transfer film 74 is taken out from the second supply reel 70 and further guided along a plurality of guide shafts 75. Subsequently, passing below the first platen roller 11 and above the second platen roller 12, the re-transfer film 74 is taken up by the second take-up reel 72. Further, on the downstream side of first platen roller 11 in the transfer route of the re-transfer film 74, a second photo sensor 76 is arranged in order to detect a cueing position of the re-transfer film 74. Additionally, on the downstream side of the second photo sensor 76 and on the upstream side of the second platen roller 12, there is a third photo sensor 77 for detecting the re-transfer film 74.

As shown in FIGS. 9A and 9B, the above re-transfer film 74 is produced by applying the transparent receiving layer 74*c* (thickness: approx. 5 μm) on a substrate sheet 74*a* with a long band shape through a release layer 74*b*. The re-transfer film 74 is arranged so that the substrate sheet 74*c* faces the first platen roller 11 and the thermal print head 21, while the transparent receiving layer 74*c* faces the ink layer 66*b* of the ink ribbon 66 and second platen roller 12. When applying the transparent receiving layer 74*c* on the substrate sheet 74*a* through the release layer 74*b*, the transparent receiving layer 74*c* is accompanied with a black-lacquered frame-cueing mark 74*d* with respect to each frame of ink images to be transferred to the re-transfer film 74.

Returning to FIG. 7, a card storage case 80 is provided outside a right sidewall 61*a* of the casing 61. In the card storage case 80, there are stacked a plurality of card-like printing papers 81 in vertical arrangement. Note that the printing papers 81 will be referred to as "cards", hereinafter. Below the lowermost card 81 in the card case 80, a card feed roller 82 is arranged so as to be rotatable in connection with a not-shown driving source. With the rotation of the card feed roller 82 in contact with the lowermost card 81 in the direction of arrow, the cards 81 are discharged from the stack and supplied toward opposing card-cleaning rollers 83, one by one.

On the left side of the card-cleaning rollers 83, a plurality of card-transfer rollers 84A to 84C are arranged to transfer the cards 81 against the second platen roller 12 horizontally. Further, a card re-transfer position sensor 85 is disposed between the card-transfer rollers 84A in pairs and the card-transfer rollers 84B in pairs. The above second platen roller 12 is positioned between the card-transfer rollers 84B in pairs and the card-transfer rollers 84C in pairs.

On the downstream side of the card-transfer rollers 84 in the transfer route of the cards 81, a card reversing unit 86 is arranged so as to be reversible as occasion demands. This card reversing unit 86 is provided to cope with such a situation that it is required to reverse each card 81 from its front side to the back side and vice versa in order to re-transfer images to both sides of the card 81 as occasion demands.

On the downstream side of the card reversing unit 86, a card discharge sensor 87 is arranged so as to allow each card 81 after the re-transfer operation to be collected into a card collecting box 88 via the sensor 87. The card collecting box 88 is arranged outside a left sidewall 61*b* of the casing 61.

Further, the casing 61 contains the controller S for controlling the operation of the thermal transfer printing machine 60A of the second embodiment.

It is noted that the thermal transfer printing machine 60A of the second embodiment adopts the re-transfer method. Thus, the operation of the thermal transfer printing machine 60A is started by an indication of a user confirming that the ink ribbon 66 and the re-transfer film 74 have been already prepared in the casing 61. Alternatively, through the use of the controller S, the machine 60A may be activated since the first photo sensor 68 detects the presence of the ink ribbon 66 and the second photo sensor 76 detects the presence of the re-transfer film 74.

The operation of the re-transfer type thermal transfer printing machine 60A constructed above will be described with reference to FIGS. 10 and 11.

First, as shown in FIG. 10, when color-image information is printed on the transparent receiving layer 74*c* of the unprinted re-transfer film 74 through the use of multicolor inks applied on the ink ribbon 66, the thermal-head transfer-position switching unit 20 is brought into its initial state that the position of the thermal print head 21 in the thermal head carrier 23 is switched to the first transfer position to oppose the first platen roller 11, while the thermal-head press unit 30 is also brought into its initial state that the thermal print head 21 is separated from the first platen roller 11.

Under the above situation, the motor 65 connected to the first take-up reel 64 is driven to allow the first photo sensor 68 to detect the black-lacquered cueing mark 66*c* (FIG. 8A) corresponding to the first color "yellow" of the ink ribbon 66, performing a cueing operation of the ink ribbon 66 so that the leading part of the first color "yellow" reaches the thermal print head 21. Further, the motor 71 connected to the second supply reel 70 or the motor 73 connected to the second take-up reel 72 is appropriately driven to allow the second photo sensor 76 to detect the black-lacquered cueing mark 74*d* (FIG. 9A) of the unprinted re-transfer film 74, performing a cueing operation of the re-transfer film 74 so that the leading part of the frame reaches the first platen roller 11.

Next, by activating the thermal-head press unit 30 through the command from the controller S, it is performed to bring the ink ribbon 66 and the unprinted re-transfer film 74 into their tightly-contacted (press-fit) condition between the thermal head 21 and the first platen roller 11 while rotating the first platen roller 11 in the direction of arrow. Thus, while transferring the first ink ribbon 66 toward the first take-up reel 64 and also transferring the re-transfer film 74 toward the second supply reel 70, it is performed to transfer an ink image colored in yellow as the first color to the transparent receiving layer 74*c* of the re-transfer film 74 by the thermal print head 21, corresponding to image signals for yellow supplied from the controller S.

After completing to transfer the ink image (colored in yellow) to the re-transfer film 74, it is performed to depart the thermal print head 21 from the first platen roller 11. Additionally, the re-transfer film 74 is returned to a position identical to a frame-cueing position for the first color, bringing the re-transfer film 74 into standstill. Thereafter, the same operation as the above operation for the first color "yellow" is repeated for each remaining color (i.e. magenta, cyan, black) to transfer colored ink images to the transparent receiving layer 74*c* of the re-transfer film 74. Consequently, the transparent receiving layer 74*c* is changed to a color image layer having image information, such as characters and images, printed thereon. When the color printing on the re-transfer film 74 is completed, the transfer of the ink ribbon 66 and the re-transfer film 74 is stopped. Then, the thermal print head 21 is separated from the first platen roller 11, establishing the previously-mentioned initial state in the thermal-head press unit 30.

As shown in FIG. 11, when re-transferring the color image printed on the transparent receiving layer 74*c* of the re-transfer film 74 to the card 81, the position of the thermal print head 21 in the thermal head carrier 23 is switched from the first transfer position to the second transfer position by the thermal-head transfer-position switching unit 20 receiving the command from the controller S. Note that this positional change is accomplished by rotating the thermal print head 21 about the first shaft 24 in the counter clockwise direction in the figure by an angle of approx. 210°. Consequently, the thermal print head 21 is positioned so as to oppose the second platen roller 12 while remaining a gap therebetween due to the previously-established initial state.

Next, the lowermost card 81 in the card storage case 80 is taken out with the rotation of the card feed rollers 82 in the direction of an illustrated arrow. Continuously, through the use of the card cleaning rollers 83 and the card transfer rollers 84A and 84B, the so-extracted card 81 is transferred to a position to allow the right end of the card 81 to be detected by the card re-transfer position sensor 85. Then, the left end of the card 81 is positioned on the second platen roller 12.

During the above operation of the thermal-head transfer-position switching unit 20, the re-transfer film 74 is taken up by the second take-up reel 72, while the third photo sensor 77 counts up the number of black-lacquered cueing marks 74*d* (FIG. 7A). Due to this counting, the transfer of the re-transfer film 74 is stopped immediately after the leading part of the color image layer printed on the re-transfer film 74 has been transferred up to the position of the thermal print head 21 moved to the second transfer position.

Subsequently, by activating the thermal-head press unit 30, it is performed to bring the printed re-transfer film 74 and the card 81 into their tightly-contacted (press-fit) condition between the thermal head 21 and the second platen roller 12 while rotating the second platen roller 12 in the direction of arrow. Additionally, due to thermo-compression by the thermal print head 21 receiving a heating signal from the controller S, the color image layer printed on the transparent receiving layer 74*c* (FIG. 9B) of the heat transfer film 74 is peeled off the release layer 74*b* (FIG. 9B) and successively re-transferred onto the card 81.

During this re-transfer operation, the re-transfer film 74 is taken up by the second take-up reel 72. This take-up operation allows the re-transfer film 74 to be peeled off the card 81. When the re-transfer operation about the card 81 is completed, the thermal print head 21 is separated from the second platen roller 12 and successively, the card 81 is transferred to the left hand by the card transfer rollers 84A to 84C. Then, the card discharge sensor 87 detects the right end of the card 81 and thereafter, it is discharged from the casing 61 into the card collecting box 88. The re-transfer operation of the card 81 is completed in this way.

In case of printing both sides of the card 81, the card reversing unit 86 operates to turn over the card 81 upside down and thereafter, it is transferred to the right hand by the card transfer rollers 84A to 84C. When the card re-transfer position sensor 85 detects the right end of the so-transferred card 81, the rightward transfer of the card 81 comes to a standstill, so that its left end stops at the thermal print head 21 on the side of the second transfer position. Thereafter, the re-transfer operation is applied to the back side of the card 81 similarly to the above-mentioned way.

On completion of the "single-sided" or "both-sided" re-transfer operation of the card 81, the position of the thermal print head 21 in the thermal head carrier 23 is switched from the second transfer position to the first transfer position by the thermal-head transfer-position switching unit 20. Note that this positional change is accomplished by rotating the thermal print head 21 about the first shaft 24 in the clockwise direction in the figure by an angle of approx. 210°. As a result, the thermal print head 21 is positioned so as to oppose the first platen roller 11.

Then, the re-transfer film 74 is rewound toward the second supply reel 70, while the second photo sensor 76 counts up the number of black-lacquered cueing marks 74*d* (FIG. 9A) on the re-transfer film 74. After counting up a predetermined number of black-lacquered cueing marks 74*d*, the re-transfer film 74 is stopped so that its unused portion stops at the thermal print head 21 in the first transfer position. Then, the next color printing is applied on the re-transfer film 74 through the use of the ink ribbon 66 again and thereafter, the re-transfer operation is carried out against the next-coming card 81.

As mentioned above, according to the thermal transfer printing machine 60A of the second embodiment, since the thermal-head transfer-position switching unit 20 is constructed so as to selectively switch the position of the thermal print head 21 between the first transfer position to perform the color printing on the re-transfer film 74 with the use of the ink ribbon 66 and the second transfer position to perform the re-transfer operation of color-image information printed on the re-transfer film 74 on the card 81, the re-transfer operation can be accomplished without using various elements used in the conventional printing machine, for example, a combination of a thermal print head for color printing and a re-transfer heat roller (or another combination of a thermal print head for color printing and a thermal print head for re-transfer). Accordingly, the thermal transfer printing machine 60A of the second embodiment can be manufactured at a low price.

One modification of the thermal transfer printing machine 60A of the second embodiment will be described with reference to FIG. 12, in brief. Note that the descriptions are related to only differences between the second embodiment and the modification.

Figure 12:
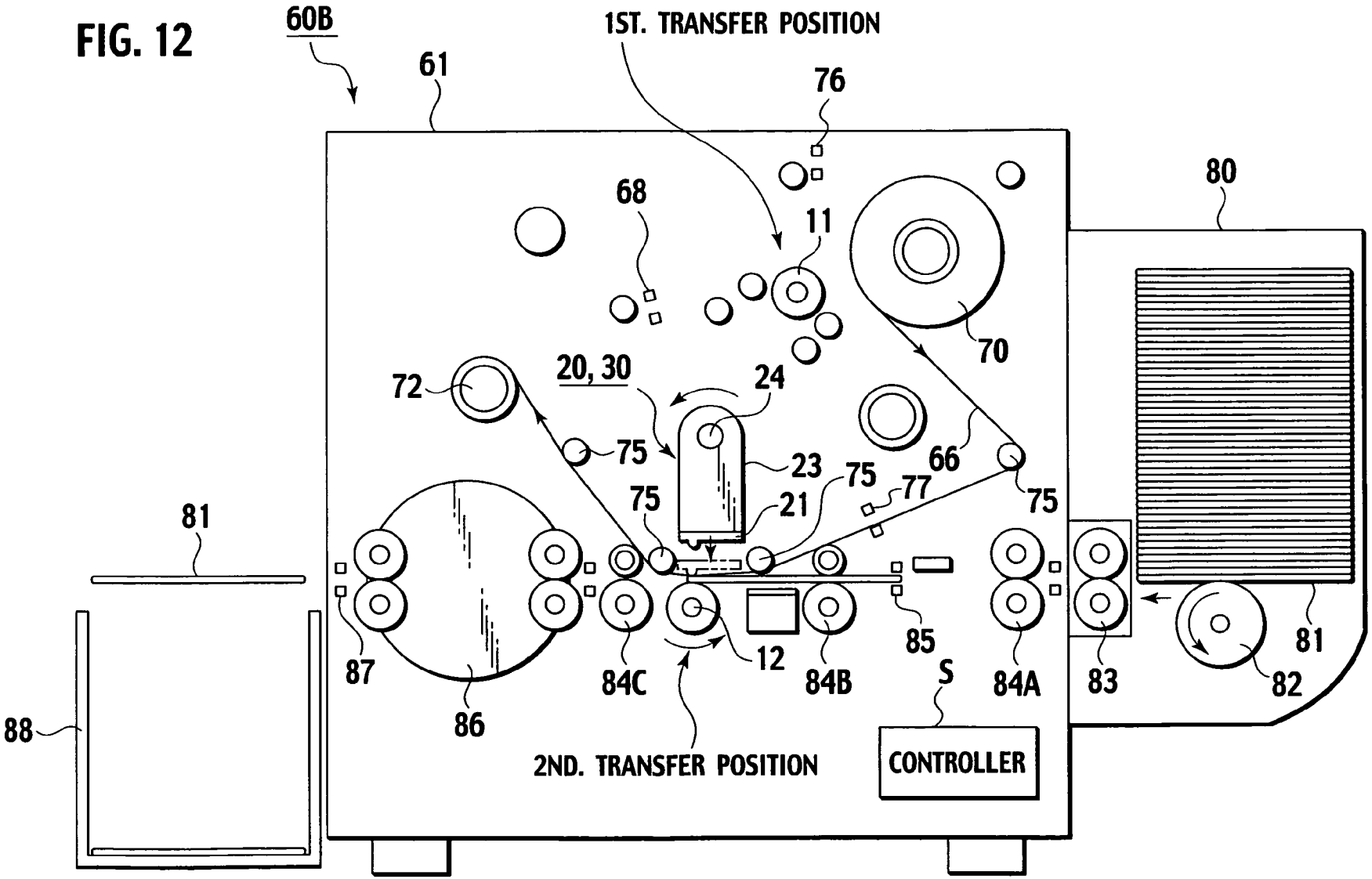
FIG. 12 is a view explaining a modification of the thermal transfer printing machine in accordance with the second embodiment.

FIG. 12 is a view to explain a thermal transfer printing machine 60B obtained by modifying a part of the thermal transfer printing machine 60A of the second embodiment.

As obvious from FIG. 12, the thermal transfer printing machine 60B is identical to the thermal transfer printing machine 60A in terms of its constitution. While, this modification differs from the second embodiment in that the position of the thermal print head 21 is previously switched to the second transfer position in order to cope with a situation avoiding the use of the re-transfer film 74, while the color-image information is directly printed on the cards 81 with the use of the ink ribbon 66.

In the thermal transfer printing machine 60B of the modification, as shown in FIG. 12, the ink ribbon 66 having multicolored inks in yellow, magenta, cyan, black, etc. is wound around the second supply reel 70 and the second take-up reel 72. In addition, the third photo sensor 77 on the upstream side of the second platen roller 12 in the transfer course of the ink ribbon 66 is utilized as a photo sensor for detecting a cueing position of the ink ribbon 66.

In arrangement, the ink ribbon 66 wound around the second supply reel 70 is led out without passing through the first platen roller 11 in the first transfer position. Then, the ink ribbon 66 is guided by the guide shafts 75 and finally wound around the second take-up reel 72 after passing above the second platen roller 12.

The thermal print head 21 in the thermal head carrier 23 is previously positioned in the second transfer position by the thermal-head transfer-position switching unit 20 receiving the command from the controller S and arranged to oppose the second platen roller 12.

In the modification, the operation of the thermal transfer printing machine 60B is started by an indication of a user confirming that only the ink ribbon 66 has been already prepared in the casing 61. Alternatively, through the use of the controller S, the machine 60A may be activated since the third photo sensor 77 detects the presence of the ink ribbon 66 and the first and second photo sensors 68, 76 detect the absence of the ink ribbon 66 and the re-transfer film 74.

The operation of the thermal transfer printing machine 60B constructed above will be described in brief.

It is performed for the third photo sensor 77 to detect the black-lacquered cueing mark 66*c* (FIG. 8A) corresponding to the first color "yellow" of the ink ribbon 66, performing a cueing operation of the ink ribbon 66 so that the leading part of the first color "yellow" reaches the thermal print head 21 in the second transfer position.

In this state, the lowermost card 81 is taken out from the card storage case 80 with the rotation of the card feed roller 82 in the direction of arrow. The so-discharged card 81 is transferred toward the second platen roller 12 by the card cleaning rollers 83 and the card transfer rollers 84A, 84B. By the thermal-head transfer-position switching unit 20, it is successively performed to bring the ink ribbon 66 and the card 81 into their tightly-contacted (press-fit) condition between the thermal head 21 and the second platen roller 12 while rotating the second platen roller 12 in the direction of arrow. Simultaneously, the thermal print head 21 is controlled so as to supply image signals by the controller S, so that the image information in yellow is printed on the card 81 directly. Thereafter, the above-mentioned direct-print operation is performed in the order of "magenta", "cyan" and "black" repeatedly, accomplishing the direct-printing on the color-image information on the card 81.

According to the above-mentioned modification, if only attaching the ink ribbon 66 in place of the re-transfer film of the second embodiment, the thermal transfer printing machine 60A can be diverted to a thermal direct-print type transfer printing machine which is advantageous in the cost of articles of consumption.

In connection, the type of usage of the thermal transfer printing machine (i.e. whether the machine should be employed as a re-transfer type machine or a direct-print type machine) would be determined by an operator's setting of the operation mode of the printing machine.

According to the present invention throughout the above-mentioned embodiments and modifications, since the thermal print head is disposed between the first platen roller and the second platen roller so as to be movable between the first transfer position opposing the first platen roller and the second transfer position opposing the second platen roller, the thermal transfer printing machine can be manufacture at a low price in comparison with the conventional printing machine adopting two thermal print heads.

Additionally, owing to the provision of the thermal-head rotating unit (e.g. the "thermal-head" transfer-position switching unit 20) for rotating the thermal print head between the first transfer position and the second transfer position, the position of the thermal print head can be switched between the first transfer position and the second transfer position with a simple structure.

Further, since the thermal-head carrier is provided with the thermal-head moving unit (e.g. the thermal-head press unit 30) that enables the thermal print head to approach and depart from the first platen roller and the second platen roller, there is no need of providing thermal-head press units in the first and second transfer positions individually, saving the manufacturing cost of the printing machine.

Finally, it will be understood by those skilled in the art that the foregoing descriptions are nothing but embodiments and various modifications of the disclosed thermal transfer printing machine and therefore, various changes and modifications may be made within the scope of claims.

What is claimed is:

1. A thermal transfer printing machine for transferring image information on an information carrying medium to a printing medium thermally, comprising:

a first platen roller adapted so as to be rotatable;

a second platen roller adapted so as to be rotatable, the second platen roller being separated from the first platen roller and also paralleled thereto substantially; and a thermal print head disposed between the first platen roller and the second platen roller, for effecting a thermal transfer of the image information from the information carrying medium to the printing medium, wherein the thermal print head is adapted so as to be movable between a first transfer position to allow the thermal print head to oppose the first platen roller and a second transfer position to allow the thermal print head to oppose the second platen roller.

2. The thermal transfer printing machine of claim 1, further comprising a thermal-head rotating unit for rotating the thermal print head about a first shaft as a rotating center between the first transfer position and the second transfer position, wherein the first shaft is substantially parallel to respective rotating shafts of the first platen roller and the second platen roller.

3. The thermal transfer printing machine of claim 2, further comprising a thermal-head carrier in which the thermal print head is movably arranged and which constitutes a base of the thermal-head rotating unit, wherein the thermal-head carrier is provided with a thermal-head moving unit that enables the thermal print head to approach and depart from the first platen roller and the second platen roller.

4. The thermal transfer printing machine of claim 3, wherein the thermal-head rotating unit includes a first motor arranged outside the thermal-head carrier to rotate the thermal print head, and the first shaft is secured to the thermal-head carrier and rotated by the first motor.

5. The thermal transfer printing machine of claim 3, wherein the thermal-head moving unit includes a second motor arranged inside the thermal-head carrier to move the thermal print head with respect to the first platen roller and the second platen roller.

6. The thermal transfer printing machine of claim 1, further comprising a controller for controlling the operation of the thermal print head at the first transfer position and the second transfer position, wherein the controller is adapted so as to output first image signals to the thermal print head positioned at the first transfer position.

7. The thermal transfer printing machine of claim 6, wherein the controller is also adapted so as to output second image signals to the thermal print head positioned at the second transfer position, allowing two kinds of printings.

8. The thermal transfer printing machine of claim 6, wherein the controller is also adapted so as to output heating signals to the thermal print head positioned at the second transfer position, allowing a re-transfer printing where the image information printed on the information carrying medium at the first transfer position is transferred to the printing medium at the second transfer position.

9. The thermal transfer printing machine of claim 1, wherein the information carrying medium is formed by either an ink ribbon or a re-transfer film having the image information printed thereon, while the printing medium is formed by either a printing paper or a re-transfer film having no image information printed thereon.

* * * * *